US010639904B2

(12) United States Patent
Nakamura et al.

(10) Patent No.: US 10,639,904 B2
(45) Date of Patent: May 5, 2020

(54) LIQUID EJECTING APPARATUS AND METHOD OF REPLACING LIQUID EJECTING HEAD

(71) Applicant: SEIKO EPSON CORPORATION, Tokyo (JP)

(72) Inventors: Hiroyuki Nakamura, Shiojiri (JP); Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/269,832

(22) Filed: Feb. 7, 2019

(65) Prior Publication Data

US 2019/0240986 A1 Aug. 8, 2019

(30) Foreign Application Priority Data

Feb. 7, 2018 (JP) ..... 2018-020075

(51) Int. Cl.

| | |
|---|---|
| ***B41J 2/175*** | (2006.01) |
| ***B41J 2/165*** | (2006.01) |
| ***B41J 2/155*** | (2006.01) |
| ***B41J 11/00*** | (2006.01) |

(52) U.S. Cl.

CPC ..... *B41J 2/17596* (2013.01); *B41J 2/155* (2013.01); *B41J 2/16508* (2013.01); *B41J 2/16523* (2013.01); *B41J 2/16532* (2013.01); *B41J 2/175* (2013.01); *B41J 2/17509* (2013.01); *B41J 2/17523* (2013.01); *B41J 11/00* (2013.01)

(58) Field of Classification Search

CPC ..... B41J 2/1707

See application file for complete search history.

(56) References Cited

U.S. PATENT DOCUMENTS

2001/0020970 A1* 9/2001 Kuribayashi ..... B41J 2/175 347/85
2006/0164470 A1* 7/2006 Langford ..... B41J 2/1707 347/84
2008/0024553 A1* 1/2008 Morgan ..... B41J 2/1707 347/42

(Continued)

FOREIGN PATENT DOCUMENTS

JP 01087354 A * 3/1989 ..... B41J 2/175
JP 2000025248 A * 1/2000 ..... B41J 2/19

(Continued)

*Primary Examiner* — Shelby L Fidler
(74) *Attorney, Agent, or Firm* — Workman Nydegger

(57) ABSTRACT

A liquid ejecting apparatus includes a liquid ejecting portion configured to eject a liquid, a liquid supply flow path of which a downstream end portion is attachably/detachably connected to the liquid ejecting portion and through which the liquid is supplied from a liquid accommodating portion that accommodates the liquid to the liquid ejecting portion, an opening/closing valve capable of opening and closing the liquid supply flow path, an atmosphere communication path connected to the liquid supply flow path on a downstream side of the opening/closing valve, an atmosphere release valve capable of opening and closing the atmosphere communication path, a suction mechanism capable of sucking the liquid in the liquid ejecting portion, and a control device configured to control operations of the opening/closing valve, the atmosphere release valve, and the suction mechanism.

11 Claims, 11 Drawing Sheets

(56) References Cited

U.S. PATENT DOCUMENTS

| | | | | |
|---|---|---|---|---|
| 2009/0066747 | A1* | 3/2009 | Hays | B41J 2/16517 347/23 |
| 2010/0238227 | A1* | 9/2010 | Nystrom | B41J 2/16526 347/19 |
| 2011/0164080 | A1* | 7/2011 | Ring | B41J 2/16517 347/9 |
| 2011/0279603 | A1* | 11/2011 | Borra | B41J 2/175 347/92 |
| 2012/0050421 | A1 | 3/2012 | Hamasaki et al. | |
| 2012/0293592 | A1* | 11/2012 | Hibbard | B41J 2/175 347/92 |
| 2013/0235131 | A1 | 9/2013 | Watanabe et al. | |

FOREIGN PATENT DOCUMENTS

| | | | | |
|---|---|---|---|---|
| JP | 2003-136746 | A | | 5/2003 |
| JP | 2003-326739 | A | | 11/2003 |
| JP | 2008-221623 | A | | 9/2008 |
| JP | 2009045823 | A | * | 3/2009 |
| JP | 2012-051189 | A | | 3/2012 |
| JP | 2013-216077 | A | | 10/2013 |

* cited by examiner

LIQUID EJECTING APPARATUS AND METHOD OF REPLACING LIQUID EJECTING HEAD

BACKGROUND

1. Technical Field

The present invention relates to a liquid ejecting apparatus that ejects liquid from a liquid ejecting head onto a medium and a method of replacing a liquid ejecting head in the liquid ejecting apparatus.

2. Related Art

In the related art, a liquid ejecting apparatus that performs printing by ejecting a liquid from a liquid ejecting head onto a medium is known. For example, in JP-A-2003-136746, an ink jet type printer that ejects ink from a printing head onto a paper sheet is disclosed.

The printer disclosed in JP-A-2003-136746 is configured such that the ink can be discharged from the inside of an old printing head by an operation of a vacuum pump prior to a removal of the old printing head when a printing head is replaced. Therefore, when the old printing head is removed, the ink does not leak from the old printing head, so that contamination of the inside of the printer and a medium is suppressed.

However, in the liquid ejecting apparatus disclosed in JP-A-2003-136746, it is hard to say that the liquid is uniformly discharged from the inside of the liquid ejecting head. The non-uniformity of the liquid discharge is conspicuous when a line type liquid ejecting head in which a nozzle row composed of a plurality of nozzles ejecting a liquid extends in a direction that intersects with both a transport direction of a medium and an ejection direction of a liquid. Therefore, in the related art, there is a problem that it easily takes a long time to discharge the liquid from the old liquid ejecting head when the liquid ejecting head is replaced.

SUMMARY

An advantage of some aspects of the invention is to provide a liquid ejecting apparatus in which a liquid ejecting head can be replaced easily and a method of replacing the liquid ejecting head.

According to an aspect of the invention, there is provided a liquid ejecting apparatus including a liquid ejecting head configured to eject a liquid from an ejecting port, a liquid supply flow path of which a downstream end portion is attachably/detachably connected to the liquid ejecting head and through which the liquid is supplied from a liquid accommodating portion that accommodates the liquid to the liquid ejecting head, an opening/closing valve capable of opening and closing the liquid supply flow path, an atmosphere communication path connected to the liquid supply flow path on a downstream side of the opening/closing valve and capable of communicating with an atmosphere, an atmosphere release valve capable of opening and closing the atmosphere communication path, a suction mechanism capable of sucking the liquid in the liquid ejecting head, and a control section that controls operations of the opening/closing valve, the atmosphere release valve, and the suction mechanism, in which the control section executes a discharge operation for discharging the liquid in the liquid ejecting head by performing a suction by the suction mechanism for a predetermined time in a state where the opening/closing valve and the atmosphere release valve are closed prior to a removal of the liquid ejecting head from downstream end portion of the liquid supply flow path and then opening the atmosphere release valve.

According to another aspect of the invention, there is provided a method of replacing a liquid ejecting head in a liquid ejecting apparatus, the apparatus including a liquid ejecting head configured to eject a liquid, a liquid supply flow path of which a downstream end portion is attachably/detachably connected to the liquid ejecting head and through which the liquid is supplied from a liquid accommodating portion that accommodates the liquid to the liquid ejecting head, an opening/closing valve capable of opening and closing the liquid supply flow path, an atmosphere communication path connected to the liquid supply flow path on a downstream side of the opening/closing valve and capable of communicating with an atmosphere, an atmosphere release valve capable of opening and closing the atmosphere communication path, and a suction mechanism capable of sucking the ink in the liquid ejecting head, and the method including closing an opening/closing valve, closing an atmosphere release valve, performing the suction by the suction mechanism for a predetermined time, opening the atmosphere release valve after the suction is performed, and removing the liquid ejecting head from the downstream end portion of the liquid supply flow path.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of a liquid ejecting apparatus will be described with reference to the drawings.

A liquid ejecting apparatus 11 in accordance with an embodiment is an ink jet type printer that performs recording (printing) by ejecting ink which is an example of a liquid L onto a paper sheet which is an example of a medium S.

An outline of the liquid ejecting apparatus 11 will be described.

Figure 1:
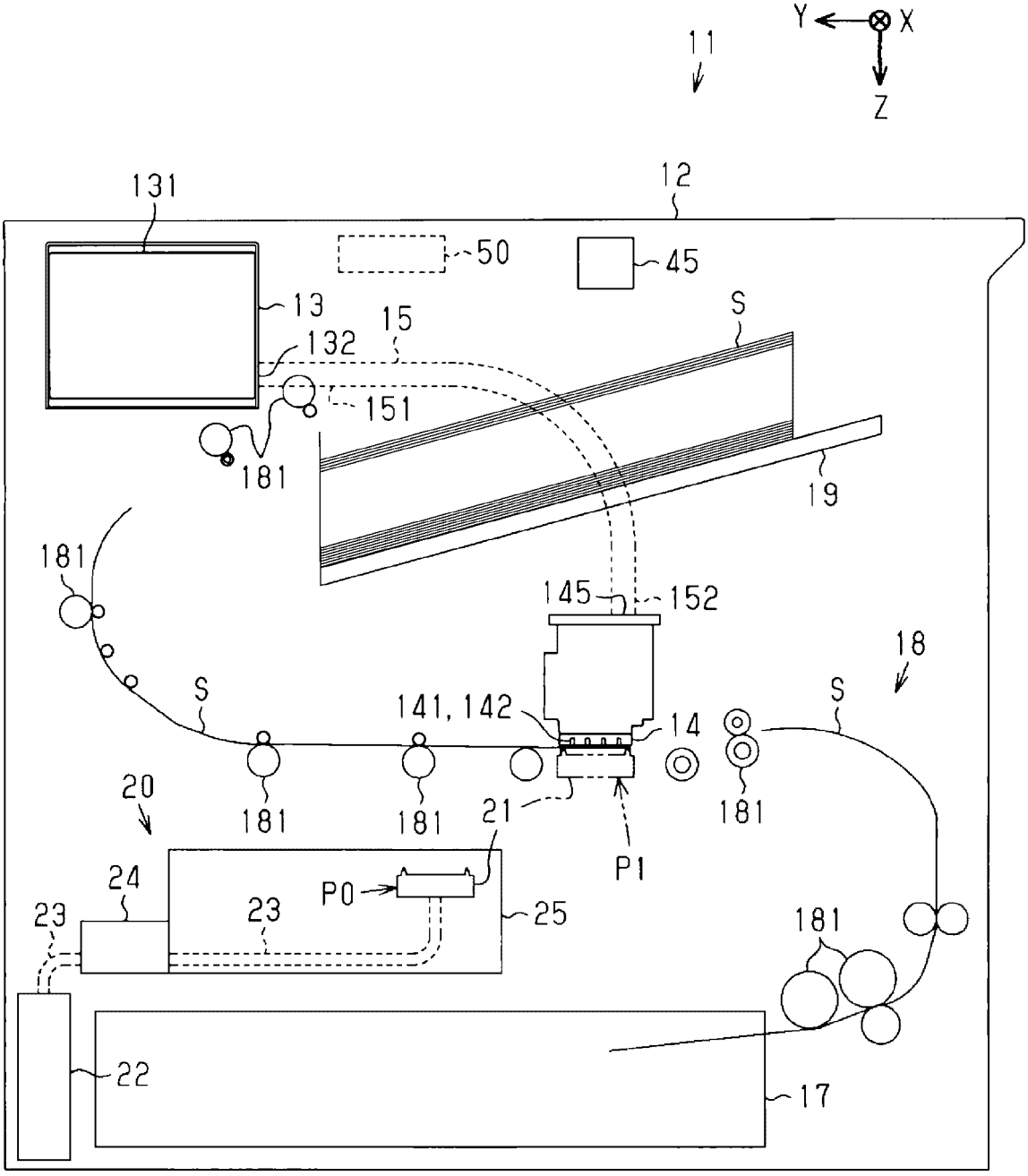
FIG. 1 is a schematic view showing an overall configuration of a liquid ejecting apparatus.

As shown in FIG. 1, the liquid ejecting apparatus 11 includes an exterior body 12, a liquid accommodating portion 13 that accommodates a liquid L, a liquid ejecting head 14 that ejects the liquid L onto a medium S, and a liquid supply flow path 15 through which the liquid L is supplied from the liquid accommodating portion 13 to a liquid ejecting head 14. Hereinafter, an area where the liquid ejecting head 14 is capable of ejecting the liquid L will be simply referred to as an "ejection area".

The liquid ejecting apparatus 11 includes a first accommodation section 17 that accommodates the medium S, a transport mechanism 18 that transports the medium S, and a second accommodation section 19 that accommodates the medium S that has passed through the ejection area. The liquid ejecting apparatus 11 includes a maintenance mechanism 20 that maintains the liquid ejecting head 14, an operation panel 45, and a control section 50 that controls the components of the liquid ejecting apparatus 11.

The liquid ejecting head 14 is a line type head extending in an X-direction. In the X direction, the ejection area of the liquid ejecting head 14 spans the entire width of the medium S passing through the ejection area.

The transport mechanism 18 transports the medium S along a transport path. The transport path is a path from the first accommodation section 17 to the second accommodation section 19 and passes through the ejection area of the liquid ejecting head 14 in a Y-direction. In the present specification, the "transport direction" means the direction in which the medium S passes in the ejection area. The X-direction intersects with the Y-direction. The X-direction may be orthogonal to the Y-direction. When it is assumed that the liquid ejecting apparatus 11 is placed on a horizontal plane, it is preferable that the plane including the X-direction and the Y-direction coincide with the horizontal plane, but the plane including the X-direction and the Y-direction may not coincide with the horizontal plane.

The liquid ejecting head 14 ejects the liquid L in a Z direction. In the present specification, the "ejection direction" means the direction in which the liquid L is ejected from the liquid ejecting head 14. The X-direction and the Y-direction intersect with the Z direction. The X-direction and the Y-direction may be orthogonal to the Z direction. When it is assumed that the liquid ejecting apparatus 11 is placed on the horizontal plane, it is preferable that the Z-direction coincide with the gravity direction, but the Z-direction may not coincide with the gravity direction.

The liquid accommodating portion 13 includes one liquid accommodation body 131 for accommodating one type of liquid L. The liquid accommodating portion 13 is configured such that a used liquid accommodation body 131 is replaceable with a new liquid accommodation body 131. Also, the liquid accommodating portion 13 may be configured such that the liquid L is replenishable by an injection of the liquid L into the liquid accommodation body 131. The liquid accommodating portion 13 includes a connection portion 132 to which an upstream end portion 151 of the liquid supply flow path 15 is connected.

Figure 2:
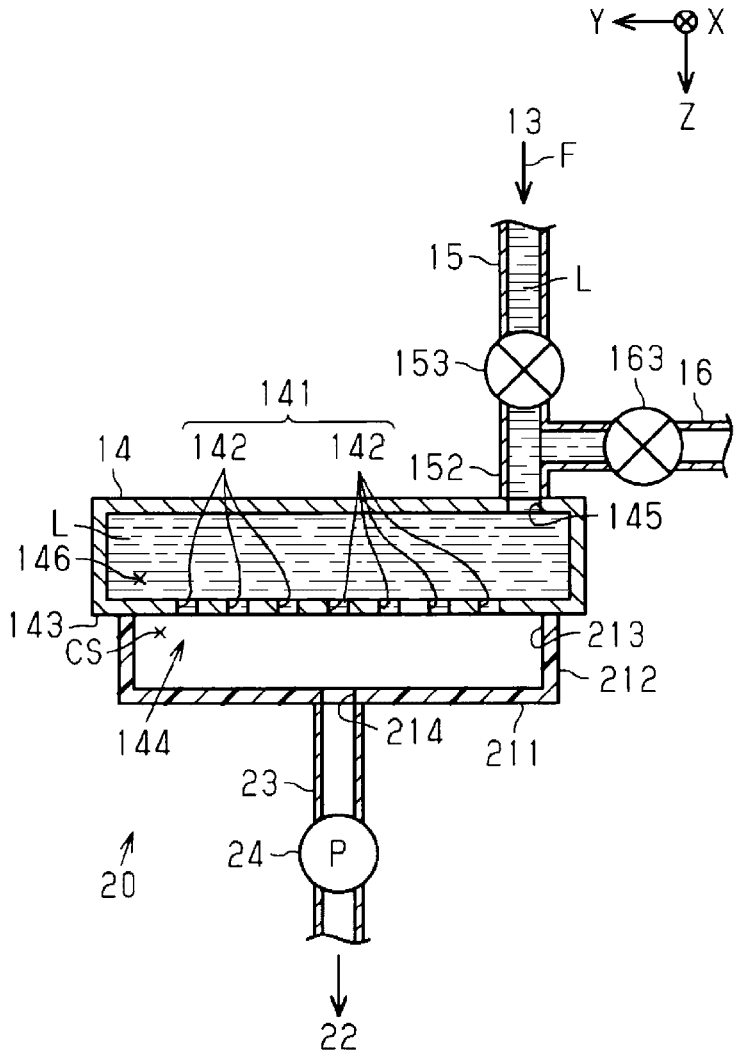
FIG. 2 is a schematic view showing an operation of a maintenance mechanism.
Figure 3:
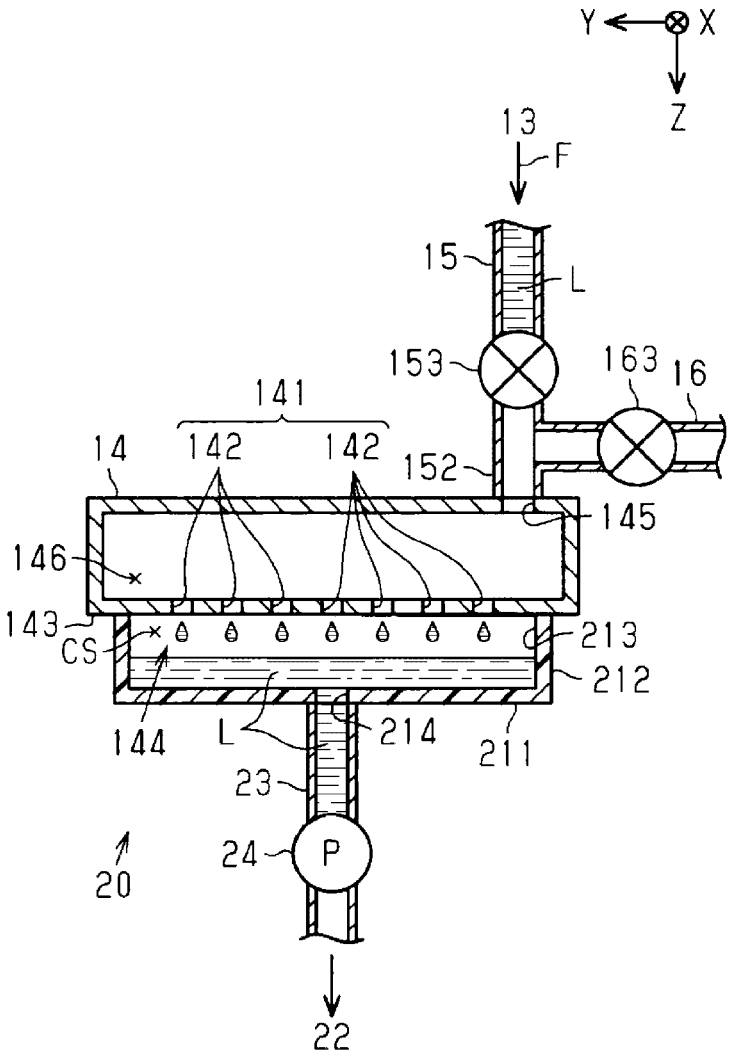
FIG. 3 is a schematic view showing the operation of the maintenance mechanism.

As shown in FIGS. 2 and 3, the liquid ejecting head 14 includes a plurality of nozzle rows 141. The plurality of nozzle rows 141 are lined at a predetermined interval in the Y-direction. Each of the plurality of nozzle rows 141 includes a plurality of nozzles 142 arranged in the D direction. The D direction obliquely intersects with the X-direction and the Y-direction on a plane which includes the X-direction and the Y-direction and may coincide with the X-direction.

The liquid ejecting head 14 includes an ejecting surface 143. The downstream ends of the plurality of nozzles 142 are opened to the ejecting surface 143 as ejecting ports 144 through which the liquid L can be ejected. The liquid ejecting head 14 includes one supply connection portion 145 to which a downstream end portion 152 of the liquid supply flow path 15 is connected. The supply connection portion 145 may be provided at a center portion of the liquid ejecting head 14 in the X-direction and the Y-direction, may be provided at an end portion, or may be provided at a portion different therefrom. Further, the liquid ejecting head 14 may include a plurality of supply connection portions 145.

The liquid ejecting head 14 includes an in-head flow path 146 that enables the communication between the supply connection portion 145 and a plurality of nozzles 142. The in-head flow path 146 extends from a first end portion of the two end portions of the liquid ejecting head 14 to a second end portion thereof on the opposite side from the first end portion in the X-direction.

The liquid supply flow path 15 includes a portion composed of a tube having flexibility. Further, the liquid supply flow path 15 is not limited to having a portion composed of a tube. The liquid supply flow path 15 may not include a portion having flexibility. The upstream end portion 151 of the liquid supply flow path 15 is connected to the connection portion 132 of the liquid accommodating portion 13.

In the embodiment, the "flow direction F" of the liquid L means the direction in which the liquid passes from the liquid accommodating portion 13 until the liquid reaches the liquid ejecting head 14. The "downstream side" as denoted in the specification means the flow direction F side from a reference position, and the "upstream side" means the opposite direction side to the flow direction F from the reference position.

The downstream end portion 152 of the liquid supply flow path 15 is attachably/detachably connected to the supply connection portion 145 of the liquid ejecting head 14. Further, the downstream end portion 152 may be the end portion of the tube itself having flexibility or may be a joint that is easily attachable/detachable to/from the supply connection portion 145.

The liquid ejecting apparatus 11 includes a first opening/closing valve 153 capable of opening and closing the liquid supply flow path 15. The first opening/closing valve 153 may be connected on the liquid ejecting head 14 side from the mid-point of the entire length of the liquid supply flow path 15 from the first opening/closing valve 153 to the liquid ejecting head 14, or may more preferably be connected to the vicinity of the downstream end portion 152 from the viewpoint of reducing the volume of the liquid supply flow path 15 from the first opening/closing valve 153 to the liquid ejecting head 14. When the first opening/closing valve 153 is opened, the liquid ejecting head 14 and the liquid accommodating portion 13 communicate with each other. When the first opening/closing valve is closed, the liquid ejecting head 14 and the liquid accommodating portion 13 are shut off from each other.

The liquid ejecting apparatus 11 includes a first atmosphere communication path 16 that enables the liquid supply flow path 15 to communicate with the atmosphere. The first atmosphere communication path 16 is connected on the downstream side of the first opening/closing valve 153 in the liquid supply flow path 15. The first atmosphere communication path 16 has a portion composed of a tube having flexibility. The first atmosphere communication path 16 is not limited to having a portion composed of a tube. The first atmosphere communication path 16 may not include a portion having flexibility.

The liquid ejecting apparatus 11 includes a first atmosphere release valve 163 capable of opening and closing the first atmosphere communication path 16. The first atmosphere release valve 163 is connected to the first atmosphere communication path 16. When the first atmosphere release valve 163 is opened, the liquid supply flow path 15 communicates with the atmosphere. When the first atmosphere release valve 163 is closed, the liquid supply flow path 15 is shut off from the atmosphere.

As shown in FIG. 1, the transport mechanism 18 includes a plurality of transport rollers 181 and a motor (not shown) that drives the plurality of transport rollers 181. The transport mechanism 18 may include a transport belt in addition to, or instead of, the plurality of transport rollers 181.

The maintenance mechanism 20 includes a cap 21 which is an example of a liquid receiving body, a waste liquid accommodating portion 22 which accommodates the waste liquid, a discharge flow path 23, a suction pump 24 which is an example of a suction mechanism, and a move mechanism 25 capable of moving the cap 21.

As shown in FIGS. 2 and 3, the cap 21 is configured in a bottomed box shape. The cap 21 has a bottom portion 211 and a wall portion 212 erected from an edge portion of the bottom portion 211. The tip end portion of the wall portion 212 is preferably a flat surface, but may not be a flat surface. The cap 21 has an opening 213 surrounded by a tip end portion of the wall portion 212. The cap 21 has a discharge hole 214 opening in the bottom portion 211.

The cap 21 is movably supported between a receiving position P1 where the cap 21 contacts with the liquid ejecting head 14 and a retracting position P0 away from the receiving position P1 and the liquid ejecting head 14. FIGS. 2 and 3 show the state where the cap 21 is at the receiving position P1. The retracting position P0 is shown in FIG. 1. The cap 21 is large enough to enclose the plurality of nozzle rows 141 when at the receiving position P1.

When the cap 21 is in the receiving position P1, the entire tip end portion of the wall portion 212 contacts with the ejecting surface 143 of the liquid ejecting head 14. That is, when the cap 21 is at the receiving position P1, together with the ejecting surface 143 of the liquid ejecting head 14, the cap 21 forms a closed space CS in which a plurality of ejecting ports 144 are opened. Further, when the cap 21 is at the retracting position P0, the cap 21 does not contact with the liquid ejecting head 14. The first opening/closing valve 153 and the first atmosphere release valve 163 are provided at positions where the volume of the portion surrounded by the plurality of ejecting ports 144, the first opening/closing valve 153, and the first atmosphere release valve 163 is smaller than the volume of the closed space CS.

As shown in FIG. 1, the upstream end portion of the discharge flow path 23 is connected to the cap 21. The downstream end portion of the discharge flow path 23 is connected to the waste liquid accommodating portion 22. The discharge flow path 23 enables the communication between the cap 21 and the waste liquid accommodating portion 22. The discharge flow path 23 has a portion composed of a tube that has the flexibility or the like. Therefore, the discharge flow path 23 is able to follow the movement of the cap 21.

The suction pump 24 is connected to the middle of the discharge flow path 23. Upon actuation, the suction pump 24 sucks the fluid in the cap 21 through the discharge flow path 23. The fluid contains at least either one of the liquid L and air. Therefore, when the cap 21 is at the receiving position P1 the suction pump 24 can apply a negative pressure to the closed space CS. That is, the suction pump 24 is able to suck the liquid L in the liquid ejecting head 14.

The move mechanism 25 has a guide rail (not shown) for movably supporting the cap 21 between the retracting position P0 and the receiving position P1 and a motor (not shown) for moving the cap 21 along the guide rail. The moving direction of the cap 21 between the retracting position P0 and the receiving position P1 can be arbitrarily set. For example, the moving direction of the cap 21 may be a direction in the Z-direction or a direction crossing the Z direction.

The operation panel 45 has an operation section (not shown) which can be operated by a user or a manager of the liquid ejecting apparatus 11. The operation section of the operation panel 45 includes a first operation section to which a start request of the liquid removal operation for discharging the liquid L the liquid ejecting head 14 is assigned prior to the removal of the liquid ejecting head 14. The operation section of the operation panel 45 includes a second operation section to which a start request of a liquid filling operation for re-supplying the liquid L to the liquid ejecting head 14 is assigned after the attachment of the liquid ejecting head 14.

The control section 50 includes an arithmetic processing section that performs arithmetic processing and a memory section that stores the program of the arithmetic processing section and the result of the arithmetic processing. As the arithmetic processing section reads and executes the program from the memory section, the control section 50 control the operation of the liquid ejecting apparatus 11 so that the print operation for performing the print by ejecting the liquid onto the medium S, the maintenance operation of the liquid ejecting head 14, and the liquid removal operation, and the liquid filling operation of the liquid ejecting head 14 are performed.

The control section 50 is connected to the first opening/closing valve 153, the first atmosphere release valve 163, the suction pump 24, the move mechanism 25, and the operation panel 45. The control section 50 can control the opening and closing of the first opening/closing valve 153 and the first atmosphere release valve 163. The control section 50 can control the suction operation of the suction pump 24. The control section 50 can control the move mechanism 25 to control the movement of the cap 21. After all, the control section 50 can control the maintenance mechanism 20. The control section 50 can receive the first start request by the operation of the first operation section and the second start request by the operation of the second operation section. The operation panel 45 has the first and the second operation sections.

Next, an example of the liquid removal operation of the liquid ejecting head 14 will be described.

Figure 4:
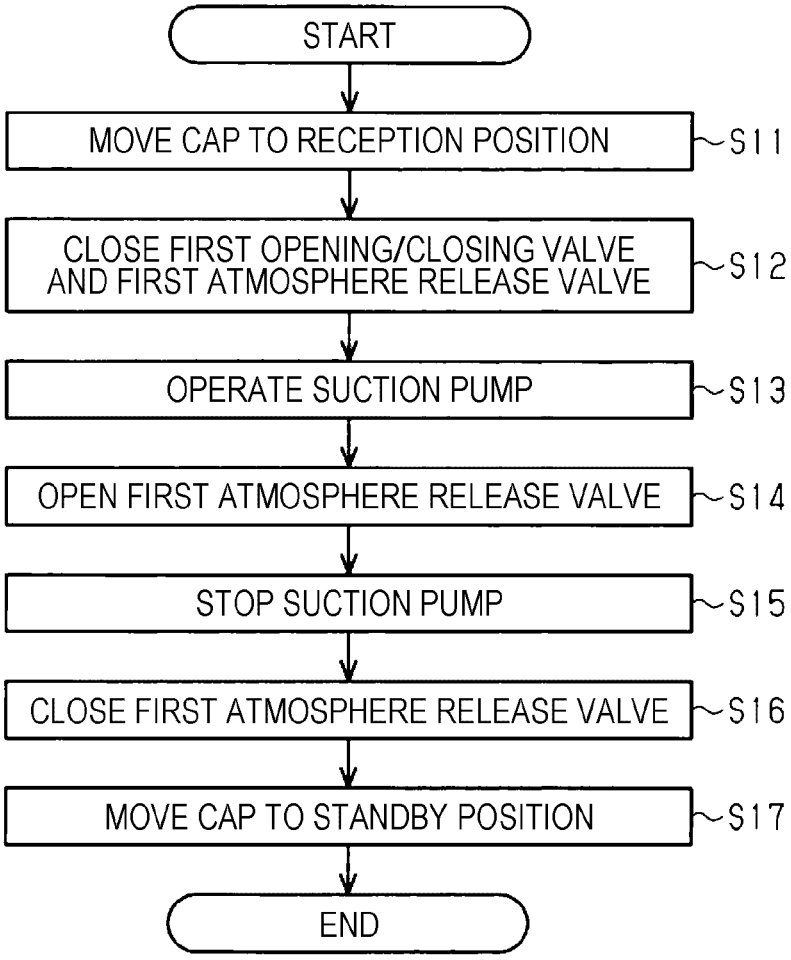
FIG. 4 is a flowchart showing a discharge process executed by a control section.

As shown in FIG. 4, when there is the first start request, the control section 50 controls the constituting elements of the liquid ejecting apparatus 11 so as to perform the liquid removal operation of the liquid ejecting head 14 by executing the discharge process to be described below. Further, the first atmosphere release valve 163 shall be opened at the start of the liquid removal operation.

In the step S11 the control section 50 controls the move mechanism 25 so that the cap 21 moves from the retracting position P0 to the receiving position P1. When the cap 21 is at the receiving position P1, the cap 21 contacts with the liquid ejecting head 14. In this way, the closed space CS in which a plurality of ejecting ports 144 are opened is formed.

In the step S12, the control section 50 closes the first opening/closing valve 153 and the first atmosphere release valve 163. In step S13, the control section 50 drives the suction pump 24. In this way, the suction pump 24 sucks the fluid in the closed space CS and discharges the fluid to the waste liquid accommodating portion 22. The control section 50 stands by while driving the suction pump 24 until a first prescribed time which is an example of the predetermined time elapses. When the first prescribed time has elapsed, the control section 50 proceeds to the process of the step S14. The first prescribed time referred to here is, for example, the time required for lowering the pressure inside the closed space CS to −50 kPa to −95 kPa by the driving of the suction pump 24.

In the step S14, the control section 50 opens the first atmosphere release valve 163. In the step S14, the control section 50 stands by while driving the suction pump 24 until the prescribed time elapses after the first atmosphere release valve 163 is opened. That is, the liquid ejecting apparatus 11 continues the suction by the suction pump 24 even after the first atmosphere release valve 163 is opened. When the prescribed time has elapsed, the control section 50 proceeds to the step S15. The prescribed time referred to here is, for example, the time required for discharging the liquid L from the first opening/closing valve 153 to the ejecting port 144. The suction pump 24 may stop the driving at the same time as the opening of the first atmosphere release valve 163 or may stop the driving prior to the opening of the first atmosphere release valve 163.

In the step S15, the control section 50 stops the suction pump 24. The discharge operation for discharging the liquid L in the liquid ejecting head 14 is constituted by the processing of steps S11 to S15. In the step S16, the control section 50 closes the first atmosphere release valve 163. That is, the liquid ejecting apparatus 11 closes the first atmosphere release valve 163 after the discharge operation ends. In the step S17, the control section 50 controls the move mechanism 25 so that the cap 21 moves from the receiving position P1 to the retracting position P0. In this way, the liquid removal operation is completed.

As described above, the liquid ejecting apparatus 11 opens the first atmosphere release valve 163 after performing the suction by the suction pump 24 for the predetermined time in a state where the first opening/closing valve 153 and the first atmosphere release valve 163 are closed prior to the removal of the liquid ejecting head 14 from the downstream end portion 152 of the liquid supply flow path 15. In this way, the liquid ejecting apparatus 11 executes the discharge operation for discharging the liquid L in the liquid ejecting head 14.

Next, an example of the liquid filling operation of the liquid ejecting head 14 will be described.

Figure 5:
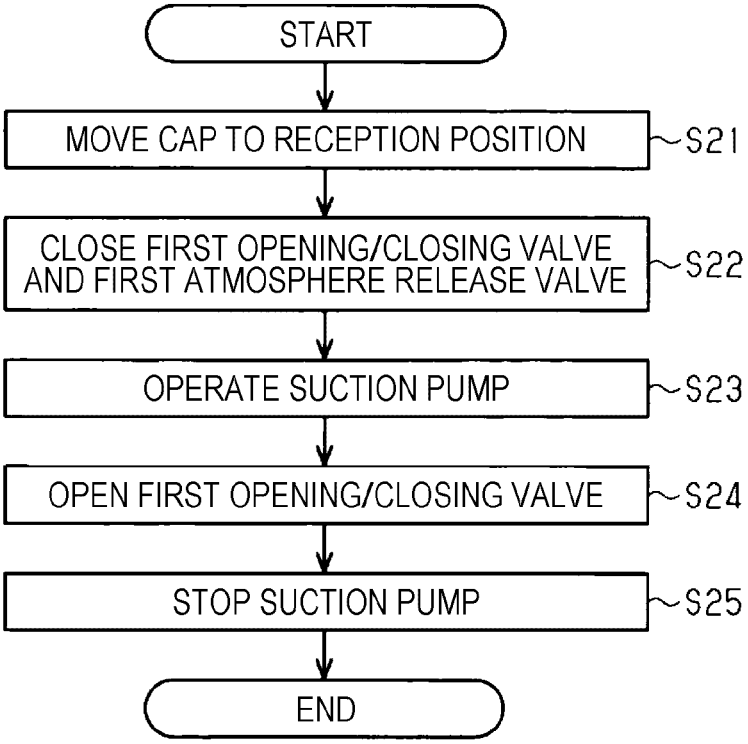
FIG. 5 is a flowchart showing a resupply process executed by the control section.

As shown in FIG. 5, if there is a second start request, the control section 50 controls the constituting element of the liquid ejecting apparatus 11 so as to perform the liquid filling operation of the liquid ejecting head 14 by executing the resupply process. In this way, the first atmosphere release valve 163 is opened at the start of the liquid filling operation.

In the step S21, the control section 50 controls the move mechanism 25 so that the cap 21 moves from the retracting position P0 to the receiving position P1. When the cap 21 is at the receiving position P1, the cap 21 contacts with the liquid ejecting head 14. In this way, a closed space CS in which a plurality of ejecting ports 144 are opened is formed.

In the step S22, the control section 50 closes the first opening/closing valve 153 and the first atmosphere release valve 163. In the step S23, the control section 50 drives the suction pump 24. In this way, the suction pump 24 sucks the fluid in the closed space CS and discharges the fluid to the waste liquid accommodating portion 22. The control section 50 stands by while driving the suction pump 24 until the second prescribed time elapses. When the second prescribed time has elapsed, the control section 50 proceeds to the process of the step S24. Here, the second prescribed time is, for example, a time required for lowering the pressure inside the closed space CS to −50 kPa to −95 kPa by the driving of the suction pump 24.

In the step S24, the control section 50 opens the first opening/closing valve 153. In the step S24, the control section 50 stands by while driving the suction pump 24 until the prescribed time elapses after the first opening/closing valve 153 is opened. That is, the liquid ejecting apparatus 11 continues the suction by the suction pump 24 even after the first opening/closing valve 153 is opened. When the prescribed time has elapsed, the control section 50 proceeds to the step S25. The prescribed time referred to here is, for example, the time required for filling the ejecting port 144 with the liquid L from the first opening/closing valve 153. The suction pump 24 may stop the driving at the same time as the opening of the first opening/closing valve 153 or may stop the driving prior to the opening of the first opening/closing valve 153.

In the step S25, the control section 50 stops the suction pump 24. The resupply operation for supplying the liquid L to the liquid ejecting head 14 is constituted by the processing of steps S21 to S25. In this way, the liquid filling operation is completed. After the liquid filling operation, it is desirable to perform the operation for discharging the liquid L in the cap 21 and the operation for cleaning the ejecting surface 143.

As described above, the liquid ejecting apparatus 11 opens the first opening/closing valve 153 after performing the suction by the suction pump 24 for the predetermined time in a state where the first opening/closing valve 153 and the first atmosphere release valve 163 are closed after the liquid ejecting head 14 is removed and a liquid ejecting head 14 which is the same as, or different from, the removed liquid ejecting head 14 is connected to the downstream end portion 152 of the liquid supply flow path 15. In this way, the liquid ejecting apparatus 11 executes the resupply operation for supplying the liquid L to the liquid ejecting head 14.

Next, an example of a method of replacing the liquid ejecting head 14 in the liquid ejecting apparatus 11 will be described.

In the liquid ejecting apparatus 11, the first start request made by the use of the first operation section of the operation panel 45 is executed prior to the removal of the liquid ejecting head 14 from the downstream end portion 152 of the liquid supply flow path 15. As described above, if there is the first start request, the liquid ejecting apparatus 11 performs the liquid removal operation for discharging the liquid L from the liquid ejecting head 14. The steps S100 to S108 to be described below are included in the liquid removal operation performed by the liquid ejecting apparatus 11.

In the step S100, forming the closed space CS in which a plurality of ejecting ports 144 are opened is performed in a first contact step by the bringing of the tip end portion of the wall portion 212 of the cap 21 into contact with the ejecting surface 143 of the liquid ejecting head 14. The first contact step is executed by the processing of the step S11 of the discharge process. Here, when the tip end portion of the wall portion 212 of the cap 21 is already in contact with the ejecting surface 143 of the liquid ejecting head 14 at the time of the first start request, the step S100 may not be repeated.

Next, in the step S101, the first opening/closing valve closing step, which is an example of an opening/closing valve closing step for closing the first opening/closing valve 153, is executed. The first opening/closing valve closing step is executed by the processing of the step S12 in the discharge process.

In the step S102, the first atmosphere release valve closing step, which is an example of an atmosphere release valve closing step for closing the first atmosphere release valve 163, is performed. The first atmosphere release valve closing step is executed by the processing of step S12 in the discharge process. The first atmosphere release valve 163 remains closed in an operation other than the liquid removal operation and may have already been closed at the start of the liquid removal operation. In this case, the step S102 may not be repeated.

In the step S103, a first suction step, which is an example of a suction step executed by the suction pump 24 for the first prescribed time, is performed. The first suction step is executed by the processing of the step S13 in the discharge process.

In the step S104, an atmosphere release valve opening step of opening the first atmosphere release valve 163 is executed after the suction is performed. The atmosphere release valve opening step is executed by the processing of the step S14 in the discharge process.

In the step S105, the first suction continuation step, which is an example of the suction continuation step of continuing suction by the suction pump 24, is executed. The first suction continuation step is executed by the processing of the step S14 in the discharge process.

In the step S106, the first suction end step of ending the suction by the suction pump 24 is executed. The first suction end step is executed by the processing of the step S15 in the discharge process.

In the step S107, the second atmosphere release valve closing step for closing the first atmosphere release valve 163 is executed. The second atmosphere release valve closing step is executed by the processing of the step S16 in the discharge process.

In the step S108, a contact release step for ending the formation of the closed space CS by releasing the contact between the tip end portion of the wall portion 212 of the cap 21 and the ejecting surface 143 of the liquid ejecting head 14 is performed. The contact release step is executed by the processing of the step S17 of the discharge process.

In the step S109, a step of removing the liquid ejecting head 14 from the downstream end portion 152 of the liquid supply flow path 15 is executed. That is, the removal step is executed after the discharge operation of the liquid ejecting apparatus 11 ends. The liquid ejecting head 14 of which the connection to the liquid supply flow path 15 is released is taken out from the liquid ejecting apparatus 11. The removal step is executed by the user or the manager of the liquid ejecting apparatus 11.

Subsequently, in the step S110, a connection step of connecting the liquid ejecting head 14 to the downstream end portion 152 of the liquid supply flow path 15 is executed. The connection step is executed by the user or the manager of the liquid ejecting apparatus 11.

In the connection step, it is preferable that a new liquid ejecting head 14 other than the liquid ejecting head 14 removed in the removal step be connected. In the connection step, if necessary measures are taken, the liquid ejecting head 14 removed in the removal step may be connected. Likewise, in the connection step, a used liquid ejecting head 14, other than the liquid ejecting head 14 removed in the removal step, may be connected.

In the liquid ejecting apparatus 11, the second start request made by the use of the second operation section of the operation panel 45 is processed after the liquid ejecting head 14 is connected to the downstream end portion 152 of the liquid supply flow path 15. As described above, when there is the second start request, the liquid ejecting apparatus 11 performs a liquid filling operation for resupplying the liquid L to the liquid ejecting head 14. The steps of S111 to S117 to be described below are included in the liquid filling operation performed by the liquid ejecting apparatus 11.

In the step S111, like in the first contact step of the step S100, the second contact step of forming the closed space CS in which a plurality of ejecting ports 144 are opened is executed. The second contact step is executed by the processing of the step S21 of the resupply process.

In the step S112, a second opening/closing valve closing step of closing the first opening/closing valve 153 is executed. The second opening/closing valve closing step is executed by the processing of the step S22 in the resupply process.

In the step S113, the third atmosphere release valve closing step of closing the first atmosphere release valve 163 is executed. The third atmosphere release valve closing step is executed by the processing of the step S22 in the resupply process. Further, the first atmosphere release valve 163 remains closed in an operation other than the liquid filling operation and may have already been closed at the start of the liquid filling operation. In this case, the step S113 may not be repeated.

In the step S114, the second suction step of performing suction by the suction pump 24 for the second prescribed time is performed. The second suction step is executed by the processing of the step S23 in the resupply process.

In the step S115, the opening/closing valve opening step of opening the first opening/closing valve 153 is performed after the suction is performed. The opening/closing valve opening step is executed by the processing of the step S24 in the resupply process.

In the step S116, the second suction continuation step of continuing the suction by the suction pump 24 performed. The second suction continuation process is executed by the processing of the step S24 in the resupply process.

In the step S117, the second suction end step of ending the suction by the suction pump 24 is performed. The second suction end step is executed by the processing of the step S25 in the resupply process. After the second suction end step, the operation for discharging the liquid L in the cap 21 and the operation for cleaning the ejecting surface 143 may be performed.

Next, the operation of the liquid ejecting apparatus 11 and the method of replacing the liquid ejecting head 14 will be described.

The liquid ejecting apparatus 11 in accordance with the present embodiment includes a line type liquid ejecting head 14. The line type liquid ejecting head 14 has a larger volume of the in-head flow path 146 and a larger number of nozzle rows 141 than the serial type liquid ejecting head. Therefore, the negative pressure applied to the plurality of nozzles 142 is likely to be less than uniform when the suction pump 24 is driven. Therefore, there is a problem that it is likely to take a long time, a time for driving the suction pump 24, to discharge the liquid L from the liquid ejecting head 14 in the liquid ejecting apparatus in the related art.

As shown in FIG. 2, the liquid ejecting apparatus 11 in accordance with the embodiment executes the discharge operation prior to the removal of the liquid ejecting head 14. In the discharge operation, the suction by the suction pump 24 is performed in a state where the first opening/closing valve 153 capable of opening and closing the liquid supply flow path 15 and the first atmosphere release valve 163 capable of opening and closing the first atmosphere communication path 16 are closed.

Therefore, the negative pressure applied to the liquid ejecting head 14 is raised before the first atmosphere release valve 163 is opened. Further, the negative pressure applied to the liquid ejecting head 14 is made uniform in the closed space CS. The opening of the first atmosphere release valve 163 is performed in a state where the negative pressure applied to the liquid ejecting head 14 is made uniform and raised.

Therefore, as shown in FIG. 3, when the first atmosphere release valve 163 is opened, the liquid L in the liquid ejecting head 14 is easily discharged uniformly from the liquid ejecting head 14. In this way, the time required for discharging the liquid L in the liquid ejecting head 14 can be shortened.

Further, by the uniform discharge of the liquid L from the plurality of nozzles 142, the liquid L hardly remains on the downstream side of the first opening/closing valve 153 in the liquid supply flow path 15 and in the liquid ejecting head 14. Therefore, when the liquid ejecting head 14 is taken out, the leakage of the liquid L from the liquid supply flow path 15 and the liquid ejecting head 14 is suppressed. Therefore, contamination of the inside of the liquid ejecting apparatus 11 and the medium S is suppressed.

If the liquid L remains on the downstream side of the first opening/closing valve 153 in the liquid supply flow path 15, the liquid L is likely to leak out when the liquid ejecting head 14 is removed from the downstream end portion 152 of the liquid supply flow path 15 while the first atmosphere release valve 163 is kept open. In contrast, the liquid ejecting apparatus 11 in accordance with the embodiment closes the first atmosphere release valve 163 when the discharge operation ends. That is, the first opening/closing valve 153 and the first atmosphere release valve 163 are closed. Therefore, the liquid L hardly leaks out from the liquid supply flow path 15 due to the action of atmospheric pressure.

Further, the liquid ejecting apparatus 11 performs the resupply operation after removing the liquid ejecting head 14 and connecting a liquid ejecting head 14, which is the same as, or different from, the liquid ejecting head 14, to the downstream end portion 152 of the liquid supply flow path 15. In the resupply operation, the first opening/closing valve 153 is opened in a state where a negative pressure is applied to the liquid ejecting head 14. Therefore, the time required for supplying the liquid L into the liquid ejecting head 14 is shortened.

According to the above embodiment, the following effects can be obtained.

(1) In the liquid ejecting apparatus 11, the liquid L in the liquid ejecting head 14 is easily discharged uniformly from the liquid ejecting head 14. In this way, the time required for discharging the liquid L in the liquid ejecting head 14 can be shortened. Therefore, it is possible to replace the liquid ejecting head 14 easily.

(2) In the liquid ejecting apparatus 11, the suction by the suction pump 24 continues even after the first atmosphere release valve 163 is opened. Therefore, the discharge of the liquid L in the liquid ejecting head 14 is performed more reliably.

(3) In the liquid ejecting apparatus 11, the first atmosphere release valve 163 is closed after the end of the discharge operation. Therefore, even if the liquid L remains on the downstream side of the first opening/closing valve 153 in the liquid supply flow path 15 when the liquid ejecting head 14 is removed, the leakage of the liquid L from the connection portion between the liquid supply flow path 15 and the liquid ejecting head 14 can be suppressed.

(4) In the liquid ejecting apparatus 11, the first opening/closing valve 153 is opened in a state where a negative pressure is applied to the liquid ejecting head 14 after the liquid ejecting head 14 is connected to the downstream end portion 152 of the liquid supply flow path 15. Therefore, the time required for supplying the liquid L into the liquid ejecting head 14 can also be shortened.

(5) In the liquid ejecting apparatus 11, the suction by the suction pump 24 continues even after the first opening/closing valve 153 is opened. Therefore, the supply of the liquid L into the liquid ejecting head 14 is performed more reliably.

(6) In the liquid ejecting apparatus 11, the first opening/closing valve 153 and the first atmosphere release valve 163 are provided at positions where the volume of the portion surrounded by the plurality of ejecting ports 144, the first opening/closing valve 153, and the first atmosphere release valve 163 is smaller than the volume of the closed space CS. Therefore, it is possible to prevent the liquid from remaining in a portion surrounded by the plurality of ejecting ports 144, the first opening/closing valve 153, and the first atmosphere release valve 163 after the liquid removal operation.

(7) In the method of replacing the liquid ejecting head 14, the liquid L in the liquid ejecting head 14 is likely to be discharged uniformly from the liquid ejecting head 14. In this way, the time required for discharging the liquid L in the liquid ejecting head 14 can be shortened. Therefore, it is possible to easily replace the liquid ejecting head 14.

(8) In the method of replacing the liquid ejecting head 14, the suction by the suction pump 24 continues even after the first atmosphere release valve 163 is opened. Therefore, the liquid L in the liquid ejecting head 14 can be discharged more reliably.

The above embodiment may be modified as in the modification examples shown below. Further, the configuration included in the above embodiment may be arbitrarily combined with the configurations included in the following modification examples or the configurations included in the following modification examples may be arbitrarily combined with each other. In the following description, like numerals reference like constituting elements with the similar functions described previously and the overlapping descriptions will not be repeated.

Figure 7:
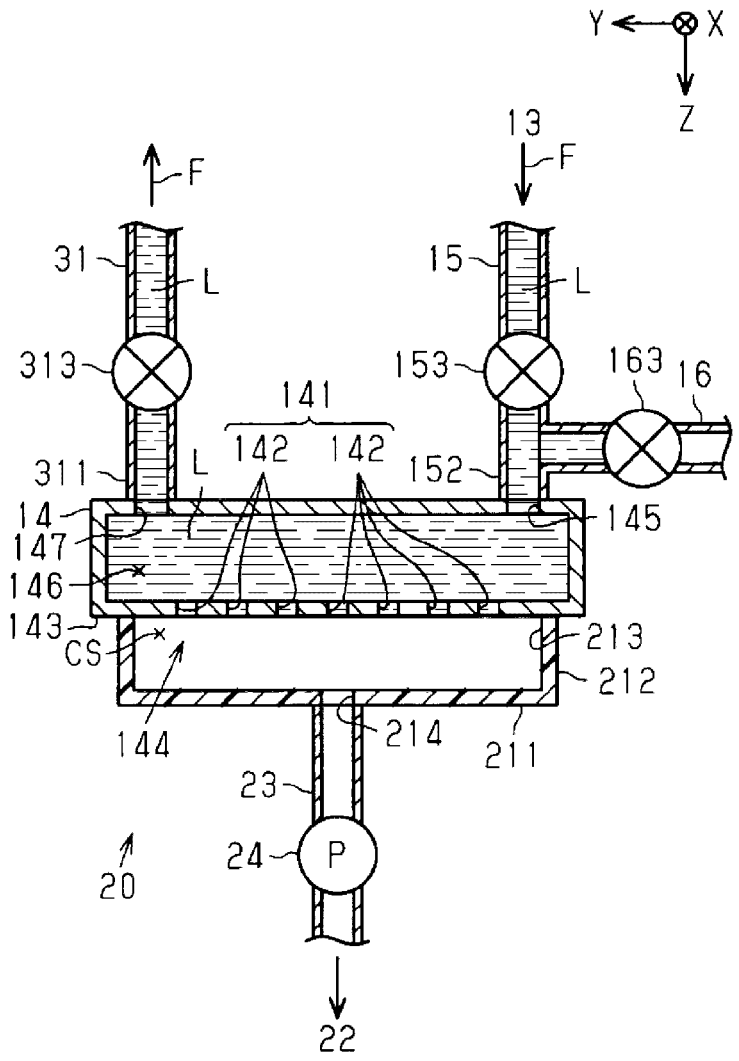
FIG. 7 is a schematic view showing an operation of a maintenance mechanism of a first modification example.
Figure 8:
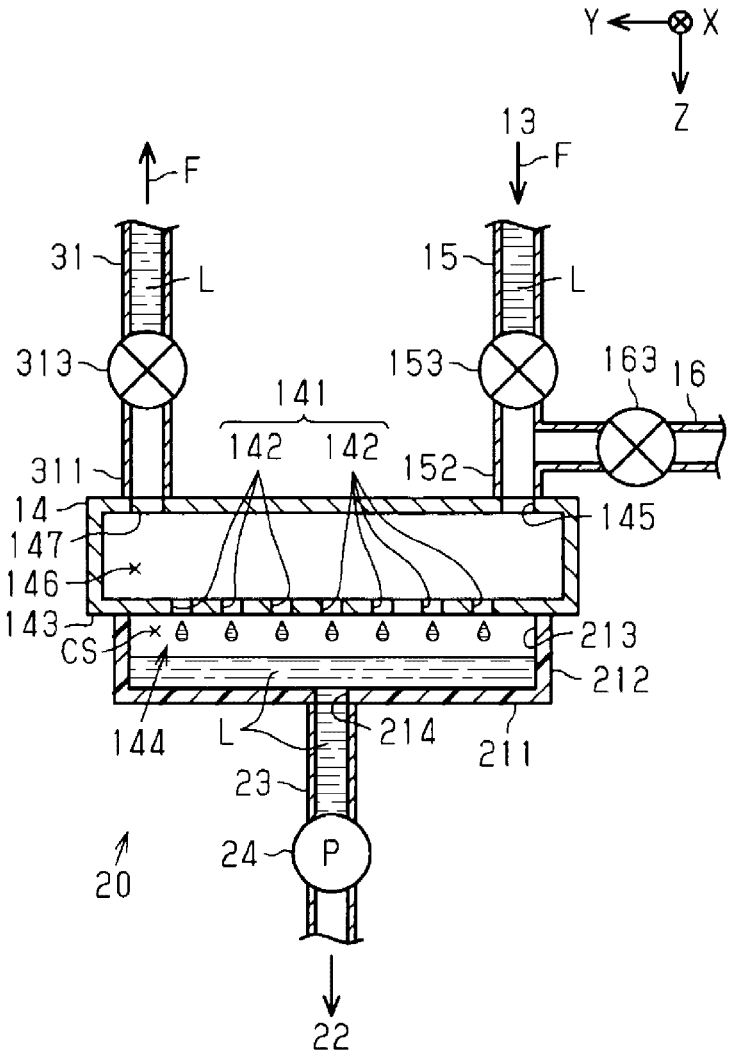
FIG. 8 is a schematic view showing the operation of the maintenance mechanism of the first modification example.

As in the first modification example shown in FIGS. 7 and 8, the liquid ejecting apparatus 11 includes one liquid collection flow path 31 for collecting the liquid L not ejected by the liquid ejecting head 14. The liquid collection flow path 31 includes a portion composed of a tube having flexibility. The liquid collection flow path 31 is not limited to including a portion constituted by a tube. The liquid collection flow path 31 may not include a portion having flexibility. A downstream end portion (not shown) of the liquid collection flow path 31 is connected to the collection section of the liquid L.

"Flow direction F" of the liquid L in the liquid collection flow path 31 means the direction in which the liquid passes from the liquid ejecting head 14 to the collection section of the liquid L. The collection section of the present modification example may be any of the liquid accommodation body connected to the liquid accommodation body 131, a liquid supply flow path 15, and a liquid supply flow path 15 separate from the liquid accommodation body 131.

The liquid ejecting head 14 includes one collection connection portion 147 to which the upstream end portion 311 of the liquid collection flow path 31 is attachably/detachably connected. The collection connection portion 147 may be provided at the center of the liquid ejecting head 14 in the X-direction and the Y-direction, may be provided at the end portion, or may be provided at a portion different therefrom. Further, the liquid ejecting head 14 may include a plurality of collection connection portions 147.

The upstream end portion 311 is connected to the collection connection portion 147 of the liquid ejecting head 14. The upstream end portion 311 may be the end portion of the flexible tube itself or may be a joint that can be easily attached/detached to/from the collection connection portion 147.

The liquid ejecting apparatus 11 includes one second opening/closing valve 313 for opening and closing the liquid collection flow path 31. From the viewpoint of reducing the volume of the liquid collection flow path 31 from the second opening/closing valve 313 to the liquid ejecting head 14, the second opening/closing valve 313 is preferably connected on the liquid ejecting head 14 side from the mid-point of the entire length of the liquid collection flow path 31, and more preferably to the vicinity of the upstream end portion 311 of the liquid collection flow path 31. When the second opening/closing valve 313 is opened, the liquid ejecting head 14 and the liquid collection section communicate with each other. When the second opening/closing valve 313 is closed, the liquid ejecting head 14 and the liquid collection portion are shut off from each other.

As shown in FIG. 4, the control section 50 of the first modification example closes the second opening/closing valve 313 in addition to the first opening/closing valve 153 and the first atmosphere release valve 163 in the step S12 in the discharge process.

As shown in FIG. 5, the control section 50 of the first modification example closes the second opening/closing valve 313 in addition to the first opening/closing valve 153 and the first atmosphere release valve 163 in the step S22 of the resupply process.

Figure 6:
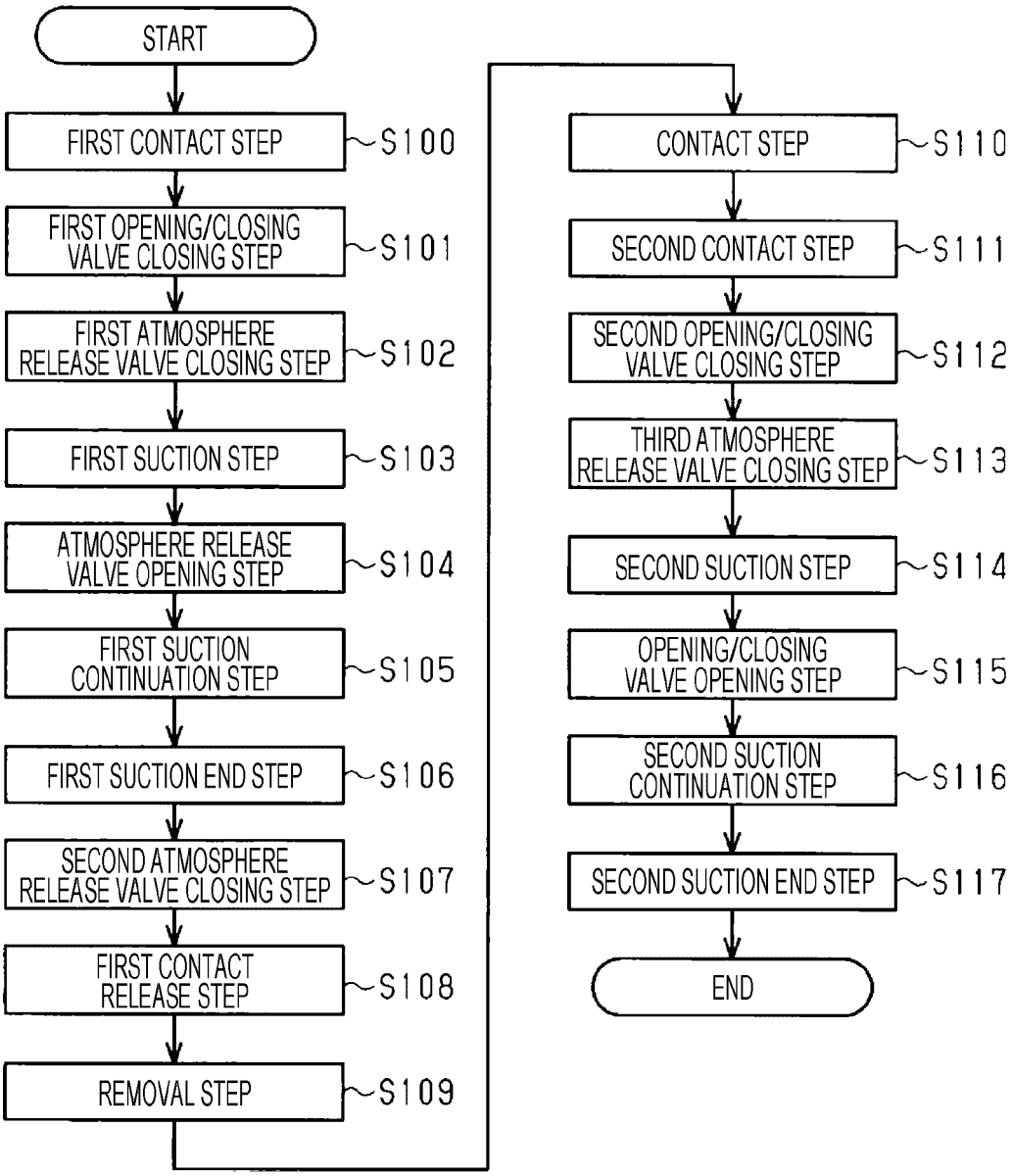
FIG. 6 is a flowchart showing a procedure in a method of replacing a liquid ejecting head.

As shown in FIG. 6, in addition to the first opening/closing valve 153, the second opening/closing valve 313 is closed in the first opening/closing valve closing step of the step S101. In the removal step of the step S109, the liquid ejecting head 14 is removed from the downstream end portion 152 of the liquid supply flow path 15 and the upstream end portion 311 of the liquid collection flow path 31.

In the connection step of the step S110, the liquid ejecting head 14 is connected to the downstream end portion 152 of the liquid supply flow path 15 and the upstream end portion 311 of the liquid collection flow path 31. In the second opening/closing valve closing step of the step S112, the second opening/closing valve 313 is closed in addition to the first opening/closing valve 153.

That is, as shown in FIG. 7, the liquid ejecting apparatus 11 of the first modification example performs the suction by the suction pump 24 for the predetermined time in a state where the first opening/closing valve 153, the second opening/closing valve 313, and the first atmosphere release valve 163 are closed prior to the removal of the liquid ejecting head 14 from the downstream end portion 152 of the liquid supply flow path 15 and the upstream end portion 311 of the liquid collection flow path 31. Thereafter, the liquid ejecting apparatus 11 executes the discharge operation for discharging the liquid L in the liquid ejecting head 14 by opening the first atmosphere release valve 163.

In this way, as shown in FIG. 8, when the first atmosphere release valve 163 is opened, the liquid L in the liquid ejecting head 14 is easily discharged uniformly from the liquid ejecting head 14.

The liquid ejecting apparatus 11 performs the suction by the suction pump 24 for the predetermined time in a state where the first opening/closing valve 153, the second opening/closing valve 313, and the first atmosphere release valve 163 are closed after the liquid ejecting head 14 is removed and a liquid ejecting head 14, which is the same as, or different from, the liquid ejecting head 14, is connected to the downstream end portion 152 of the liquid supply flow path 15 and upstream end portion 311 of the liquid collection flow path 31. Thereafter, the liquid ejecting apparatus 11 opens the first opening/closing valve 153. In this way, the liquid ejecting apparatus 11 of the first modification example executes the resupply operation for supplying the liquid L to the liquid ejecting head 14. Here, the second opening/closing valve 313 may be opened at the same time as the first opening/closing valve 153 is opened.

According to the first modification example, even in the liquid ejecting apparatus 11 that includes the liquid collection flow path 31, the time required for discharging the liquid L in the liquid ejecting head 14 can be shortened. Therefore, it is possible to easily replace the liquid ejecting head 14.

Figure 9:
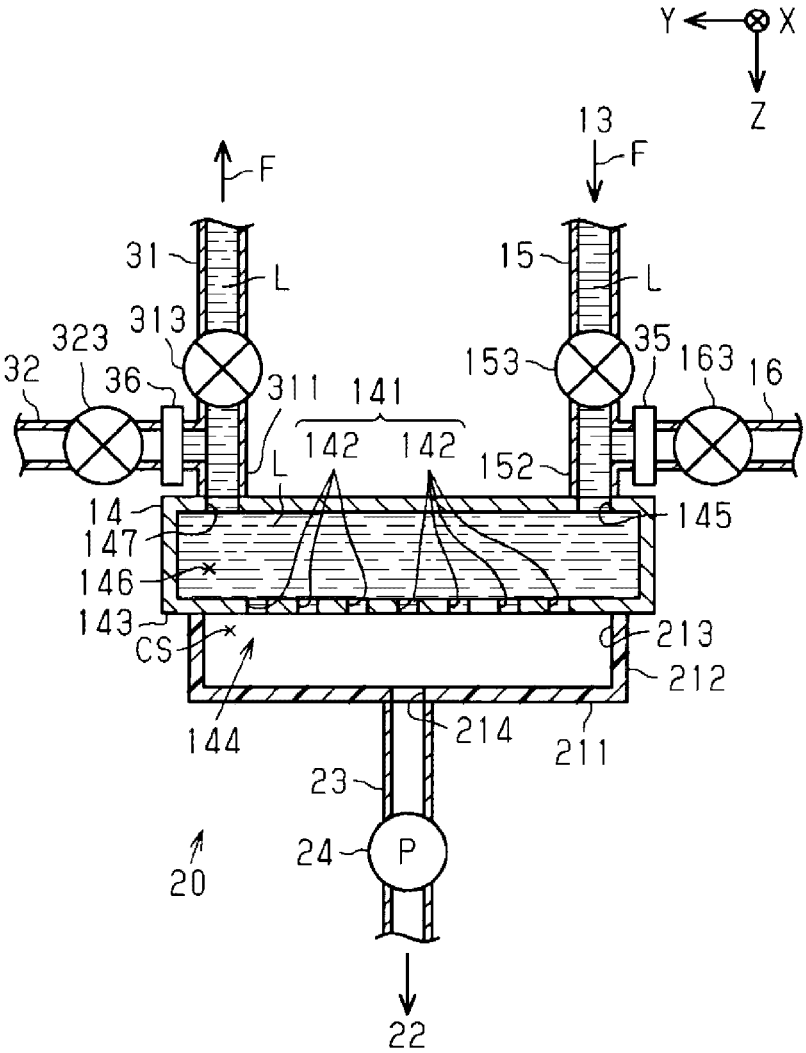
FIG. 9 is a schematic view showing the operation of the maintenance mechanism of a second modification example.
Figure 10:
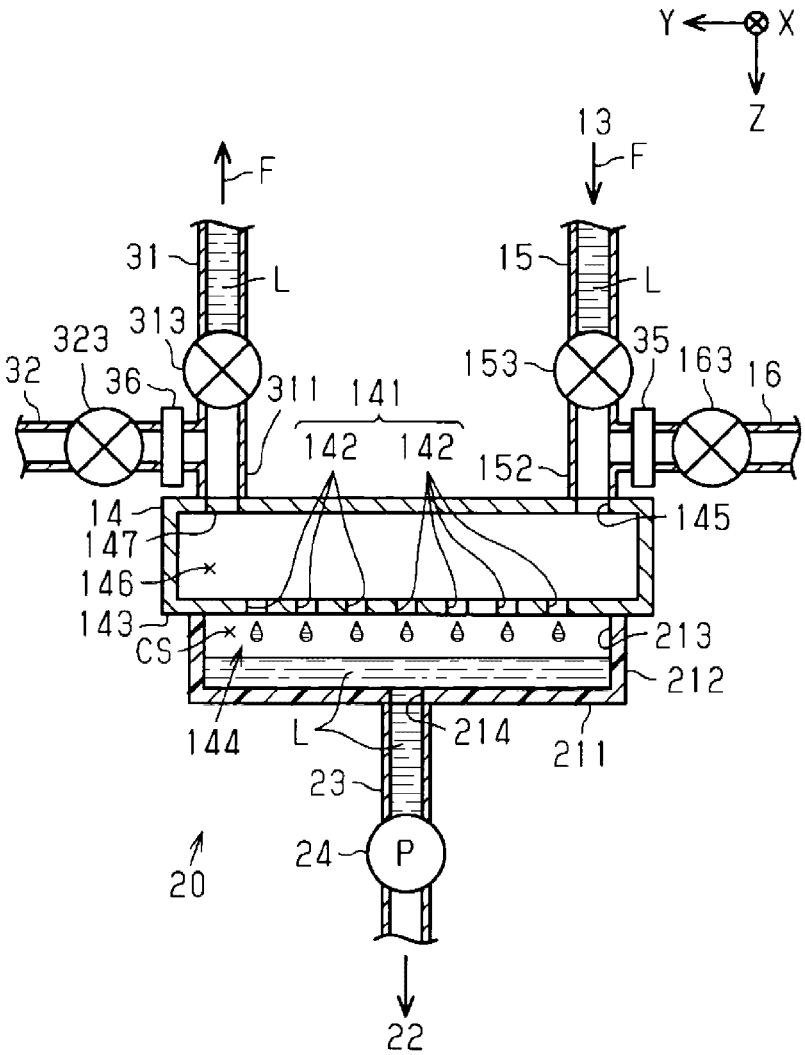
FIG. 10 is a schematic view showing the operation of the maintenance mechanism of the second modification example.

As in the second modification example shown in FIGS. 9 and 10, the liquid ejecting apparatus 11 includes a liquid collection flow path 31 and a second opening/closing valve 313 similarly to the first modification example. The liquid ejecting apparatus 11 of the second modification example includes a second atmosphere communication path 32 which is connected to the liquid collection flow path 31 on the upstream side of the second opening/closing valve 313 and capable of communicating with the atmosphere.

The liquid ejecting apparatus 11 includes a second atmosphere release valve 323 capable of opening and closing the second atmosphere communication path 32. The second atmosphere release valve 323 is connected to the second atmosphere communication path 32. When the second atmosphere release valve 323 is opened, the liquid collection flow path 31 communicates with the atmosphere. When the second atmosphere release valve 323 is closed, the liquid collection flow path 31 is shut off from the atmosphere.

As shown in FIG. 4, the control section 50 of the first modification example closes the second opening/closing valve 313 and the second atmosphere release valve 323 in addition to the first opening/closing valve 153 and the first atmosphere release valve 163 in the step S12 in the discharge process. The control section 50 opens the second atmosphere release valve 323 in addition to the first atmosphere release valve 163 in the step S14 in the discharge process. Further, in the step S14, the control section 50 may open either the first atmosphere release valve 163 or the second atmosphere release valve 323, which can be arbitrarily selected.

As shown in FIG. 5, the control section 50 of the first modification example closes a second opening/closing valve 313 and a second atmosphere release valve 323 in addition to the first opening/closing valve 153 and the first atmosphere release valve 163 in the step S22 of the resupply process. The control section 50 opens the second opening/closing valve 313 in addition to the first opening/closing valve 153 in the step S24 of the resupply process. In the step S24, the control section may open either the first opening/ closing valve 153 or the second opening/closing valve 313, which can be arbitrarily selected.

As shown in FIG. 6, the second opening/closing valve 313 is closed in addition to the first opening/closing valve 153 in the first opening/closing valve closing step of the step S101. The second atmosphere release valve 323 is closed in addition to the first atmosphere release valve 163 in the first atmosphere release valve closing step of the step S102. The second atmosphere release valve 323 is opened in addition to the first atmosphere release valve 163 in the atmosphere release valve opening step of the step S104. The second atmosphere release valve 323 is closed in addition to the first atmosphere release valve 163 in the second atmosphere release valve closing step of the step S107.

The liquid ejecting head 14 is removed from the downstream end portion 152 of the liquid supply flow path 15 and the upstream end portion 311 of the liquid collection flow path 31 in the removal step of step S109. The liquid ejecting head 14 is connected to the downstream end portion 152 of the liquid supply flow path 15 and the upstream end portion 311 of the liquid collection flow path 31 in the connection step of the step S110.

In addition to the first opening/closing valve 153, the second opening/closing valve 313 is closed in the second opening/closing valve closing step of the step S112. In addition to the first atmosphere release valve 163, the second atmosphere release valve 323 is closed in the third atmosphere release valve closing step of the step S113. In addition to the first opening/closing valve 153, the second opening/closing valve 313 is opened in the opening/closing valve opening step of the step S115.

That is, as shown in FIG. 9, the liquid ejecting apparatus 11 of the second modification example performs the suction by the suction pump 24 for the predetermined time in a state where the first opening/closing valve 153, the second opening/closing valve 313, the first atmosphere release valve 163, and the second atmosphere release valve 323 are closed prior to the removal of the liquid ejecting head 14 from the downstream end portion 152 of the liquid supply flow path 15 and the upstream end portion 311 of the liquid collection flow path 31. Thereafter, the liquid ejecting apparatus 11 executes the discharge operation for discharging the liquid L in the liquid ejecting head 14 by opening the first atmosphere release valve 163 and the second atmosphere release valve 323.

In this way, as shown in FIG. 10, when the first atmosphere release valve 163 and the second atmosphere release valve 323 are opened, the liquid L in the liquid ejecting head 14 is easily discharged from the liquid ejecting head 14 uniformly.

According to the second modification example, even in the liquid ejecting apparatus 11 that includes the liquid collection flow path 31, the time required for discharging the liquid L in the liquid ejecting head 14 can be shortened. In particular, the liquid ejecting apparatus 11 of the second modification example is configured such that both the liquid supply flow path 15 and the liquid collection flow path 31 communicate with the atmosphere in a state where negative pressure is applied to the liquid ejecting head 14. Therefore, the time required for discharging the liquid L in the liquid ejecting head 14 is further shortened.

As in the second modification example shown in FIGS. 9 and 10, the liquid ejecting apparatus 11 includes a first filter 35 which is an example of a filter between the first atmosphere release valve 163 in the first atmosphere communication path 16 and the liquid supply flow path 15. The liquid ejecting apparatus 11 of the second modification example includes a second filter 36 between the second atmosphere release valve 323 in the second atmosphere communication path 32 and the liquid collection flow path 31. Further, the liquid ejecting apparatus 11 may include either or neither of the two filters 35 and 36. If the second atmosphere communication path 32 is not provided, the liquid ejecting apparatus 11 may or may not include the first filter 35. The filters 35 and 36 are preferably hydrophobic filters, but may be hydrophilic filters.

According to the liquid ejecting apparatus 11 of the second modification example, a foreign matter entering from the outside when the first atmosphere release valve 163 is opened is captured by the first filter 35 before reaching the liquid ejecting head 14. A foreign matter entering from the outside when the second atmosphere release valve 323 is opened is captured by the second filter 36 before reaching the liquid ejecting head 14. Therefore, the occurrence of an ejection failure of the liquid caused by the foreign matter is suppressed.

In the liquid ejecting apparatus 11 of the second modification example, the first atmosphere communication path 16 and the first atmosphere release valve 163 may not be provided.

Figure 11:
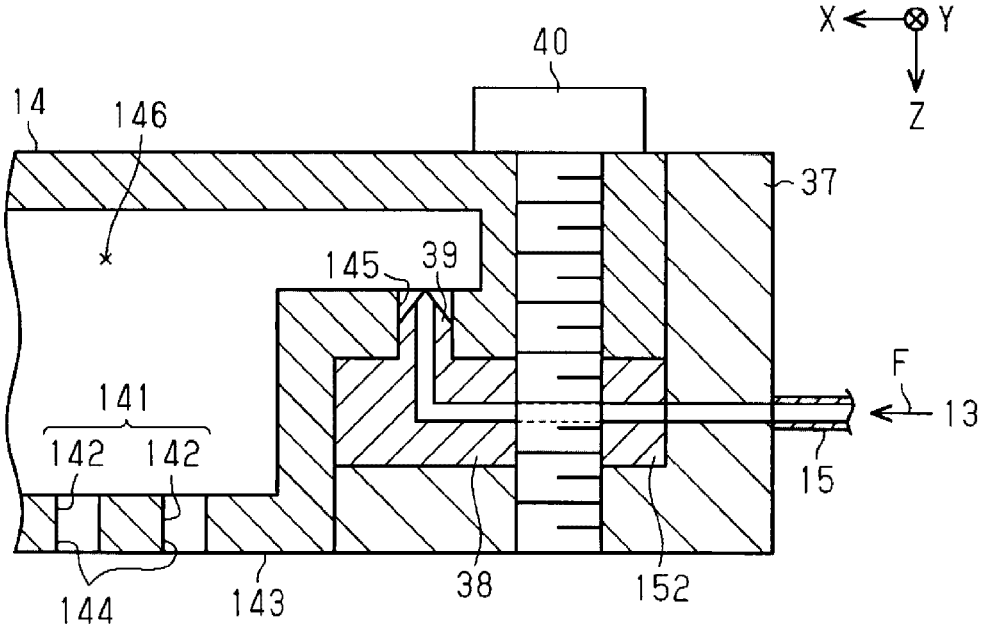
FIG. 11 is a schematic view showing a connection structure between a liquid ejecting head and a liquid supply flow path of a third modification example.

As in the third modification example shown in FIG. 11, the liquid ejecting apparatus 11 includes a head fixing portion 37 for fixing the liquid ejecting head 14 at a predetermined position inside an exterior body 12. The downstream end portion 152 of the liquid supply flow path 15 is fixed to the head fixing portion 37. The downstream end portion 152 of the third modification example includes a base portion 38 fixed to the head fixing portion 37 and a protrusion type connection portion 39 erected on the base portion 38. The protrusion type connection portion 39 extends upward in the vertical direction from the base portion 38.

The liquid ejecting head 14 has a recess type supply connection portion 145 that opens at the lower surface of the liquid ejecting head 14. The supply connection portion 145 in the liquid ejecting head 14 and the protrusion type connection portion 39 in the head fixing portion 37 are positioned such that the liquid supply flow path 15 and the in-head flow path 146 are connected to each other by the insertion of the protrusion type connection portion 39 into the supply connection portion 145 when the liquid ejecting head 14 is assembled to the head fixing portion 37. The liquid ejecting head 14 is fixed to the head fixing portion 37 from above in the vertical direction with a fastening member 40 such as a bolt.

According to the liquid ejecting apparatus 11 of the third modification example, both the removal and attachment of the liquid ejecting head 14 from and to the head fixing portion 37 and the fixing with the fastening member 40 can be performed from above in the vertical direction. Therefore, work efficiency in replacing the liquid ejecting head 14 improves.

According to the third modification example, the liquid ejecting head 14 can be connected to the downstream end portion 152 of the liquid supply flow path 15 at the same time as the liquid ejecting head 14 is assembled to the head fixing portion 37. Consequently, the convenience in replacing the liquid ejecting head 14 improves.

The method of replacing the liquid ejecting head 14 may not include at least either of the first suction continuation step of the step S105 and the second suction continuation step of the step S116. That is, the opening of the first atmosphere release valve 163 and the stopping of the suction by the suction pump 24 may be performed at the same time.

Further, the opening of the first opening/closing valve 153 and the stopping of the suction by the suction pump 24 may be performed at the same time.

In the method of replacing the liquid ejecting head 14, the atmosphere release valve opening step of the step S104 may be executed after the first suction step of the step S103 and the first suction stop step of the step S106. That is, after the suction by the suction pump 24 is stopped, the first atmosphere release valve 163 may be opened.

In the method of replacing the liquid ejecting head 14, the opening/closing valve opening step of the step S115 may be performed after the second suction step of the step S114 and the second suction stop step of the step S117. That is, after the suction by the suction pump 24 is stopped, the first opening/closing valve 153 may be opened.

In the method of replacing the liquid ejecting head 14, the first opening/closing valve closing step of the step S101 and the first atmosphere release valve closing step of the step S102 may be reversed in order or may be executed at the same time. In the method of replacing the liquid ejecting head 14, the second opening/closing valve closing step of the step S112 and the third atmosphere release valve closing step of the step S113 may be reversed in order or may be executed at the same time.

Out of the steps S100 to S108 and the steps S111 to S117 included in the method of replacing the liquid ejecting head 14, some steps that can be arbitrarily selected or the entire steps may be executed by the user or the manager of the liquid ejecting apparatus 11. In this case, out of the discharge process and the resupply process, the control section 50 may not execute the process corresponding to the step the user or the manager of the liquid ejecting apparatus 11 executes.

The removal step of the step S109 and the connection step of the step S110 included in the method of replacing the liquid ejecting head 14 may be performed by the liquid ejecting apparatus 11. The liquid ejecting apparatus 11 of the present modification example includes a first head accommodation section for accommodating the unused liquid ejecting head 14 and a second head accommodation section for accommodating the used liquid ejecting head 14. The control section 50 executes the replacement process of replacing the liquid ejecting head 14 when the discharge process ends. In the replacement process, the control section 50 controls the replacement mechanism (not shown) so as to remove the liquid ejecting head 14 in use and transport the liquid ejecting head 14 to the second head accommodation section and to transport a new liquid ejecting head 14 from the first head accommodation section and connect the liquid ejecting head 14 to the liquid supply flow path 15.

The liquid ejecting apparatus 11 may be configured to be capable of ejecting two or more types of liquid L onto the medium S. In this modification example, the liquid ejecting apparatus 11 includes a plurality of liquid accommodating portions 13 in which different types of liquid L are accommodated and a plurality of liquid supply flow paths 15 through which different types of liquid L are supplied. Further, the liquid ejecting head 14 includes a plurality of in-head flow paths 146 through which different types of liquid L flow and a plurality of nozzle rows 141 from which different types of liquid are ejected.

In the present modification example, the liquid ejecting apparatus 11 may include a first opening/closing valve 153, a first atmosphere communication path 16, and a first atmosphere release valve 163 for each of the plurality of liquid supply flow paths 15. The liquid ejecting apparatus 11 may include a first atmosphere communication path 16 and a first atmosphere release valve 163, both shared by a plurality of the liquid supply flow paths 15.

Further, in the first modification example or the second modification example, a plurality of liquid collection flow paths 31 through which different types of liquid L are collected may be provided. In this case, the liquid ejecting apparatus 11 may include the second opening/closing valve 313, the second atmosphere communication path 32, and the second atmosphere release valve 323 for each of the plurality of liquid collection flow paths 31. Further, the liquid ejecting apparatus 11 may include a second atmosphere communication path 32 and a second atmosphere release valve 323, both shared by the plurality of liquid collection flow paths 31.

The liquid ejecting apparatus 11 may include a liquid pump that sends out the liquid L in the flow direction F. The liquid ejecting apparatus 11 may include at least either one of a liquid pump connected to the liquid supply flow path 15 and a liquid pump connected to the liquid collection flow path 31.

The liquid ejecting apparatus 11 may include a buffer tank, which is an example of a negative pressure accumulation section capable of accumulating the negative pressure, between the cap 21 and the suction pump 24 in the discharge flow path 23. According to the modification example, when the first atmosphere release valve 163 is opened, a high negative pressure can be applied to the closed space CS for a long time as compared with a configuration without a buffer tank. Further, even when the volume of the in-head flow path 146 of the liquid ejecting head 14 and the cap 21 is large, the liquid L can be discharged efficiently.

In this modification example, the liquid ejecting apparatus 11 may further include a discharge opening/closing valve between the cap 21 and the buffer tank in the discharge flow path 23. In a process separate from the discharge process and the resupply process, the control section 50 drives the suction pump 24 in a state where the discharge opening/closing valve is closed so as to accumulate the negative pressure in the buffer tank. Instead of driving the suction pump 24, the control section 50 executes a process of opening the discharge opening/closing valve in the steps S13 and S23.

In the present modification example, the method of replacing the liquid ejecting head 14 includes a negative pressure accumulation step of sucking the fluid in the buffer tank by driving the suction pump 24 and accumulating the negative pressure. In the first suction step of the step S103 and the second suction step of the step S114 of the method of replacing the liquid ejecting head 14, the negative pressure accumulated in the buffer tank is applied to the liquid ejecting head 14 by the opening of the discharge opening/closing valve instead of the starting of the suction by the suction pump 24. According to the modification example, the time required for discharge operation and resupply operation can be shortened by accumulating the negative pressure in advance.

In the liquid ejecting head 14, a plurality of liquid ejecting portions may be arranged in the X-direction. The plurality of liquid ejecting portions include a plurality of nozzle rows 141. The liquid ejecting head 14 may include a branch flow path through which the liquid L is supplied from the in-head flow path 146 to each liquid ejecting unit.

The liquid ejecting apparatus 11 may include a serial type liquid ejecting head 14. Even in the serial type liquid ejecting head 14, the liquid L in the liquid ejecting head 14 is easily discharged uniformly from the liquid ejecting head 14, and the time required for discharging the liquid L in the liquid ejecting head 14 is shortened. Therefore, the liquid ejecting head 14 can be replaced easily. Furthermore, the liquid ejecting apparatus 11 of the present modification example includes a carriage that movably supports the liquid ejecting head 14 and a motor that enables the carriage to move in the X-direction.

When the liquid ejecting apparatus 11 includes a line type liquid ejecting head 14 in which a plurality of liquid ejecting heads 14 are arranged in a row, the liquid ejecting apparatus 11 may include a plurality of caps 21 corresponding to each of the plurality of liquid ejecting heads 14 and an opening/closing valve on the downstream side of each of the plurality of caps 21. In this case, with the opening/closing valve corresponding to the liquid ejecting head 14 to be replaced opened and the other opening/closing valves closed, the liquid removal operation and the liquid filling operation may be performed only on the liquid ejecting head 14 that needs replacing. In this way, the wasteful consumption of the liquid L can be suppressed.

The first start request serving as a trigger for the discharge operation is not limited to the operation of the first operation section of the operation panel 45. When the liquid ejecting apparatus 11 is configured such that the replacement processing is possible as in the above-described modification example, the first start request may preferably be made automatically when the control section 50 determines that the printing of the prescribed number of sheets is completed and/or when an ejection failure detector (not shown) detects ejection failures by a plurality of nozzles 142 and detects failure to recover from the ejection failures. In this way, the liquid ejecting head can be replaced easily.

The second start request serving as a trigger for the resupply operation may be the replacement of the liquid ejecting head 14 instead of the operation of the second operation section of the operation panel 45. The liquid ejecting head 14 of the modification example includes an individual identifier such as an IC chip. The control section 50 may read the individual information from the individual identifier of the liquid ejecting head 14 and determines whether or not the liquid ejecting head 14 is replaced.

The first opening/closing valve 153 and the first atmosphere release valve 163 may serve as one first switching valve. The first switching valve is configured to be capable of switching among a first communication state, a second communication state, and a closed state. The first communication state is a state in which the in-head flow path 146 communicates with the liquid accommodating portion 13, and the liquid accommodating portion 13 and the in-head flow path 146 do not communicate with the atmosphere. The second communication state is a state in which the in-head flow path 146 does not communicate with the liquid accommodating portion 13, but the in-head flow path 146 communicates with the atmosphere, and the liquid accommodating portion 13 does not communicate with the atmosphere. The closed state is a state in which the in-head flow path 146 does not communicate with the liquid accommodating portion 13, and the in-head flow path 146 and the liquid accommodating portion 13 do not communicate with the atmosphere.

The second opening/closing valve 313 and the second atmosphere release valve 323 may serve as one second switching valve. The second switching valve is configured to be capable of switching among a first communication state, a second communication state, and a closed state. The first communication state is a state in which the in-head flow path 146 communicates with the collection section and the collection section and the in-head flow path 146 do not communicate with the atmosphere. The second communication state is a state in which the in-head flow path 146 does not communicate with the collection section, the in-head flow path 146 communicates with the atmosphere, and the collection section does not communicate with the atmosphere. The closed state is a state in which the in-head flow path 146 does not communicate with the collection section and the in-head flow path 146 and the collection section do not communicate with the atmosphere. The configuration of the collection section is the same as described in the first modification example and the second modification example.

The liquid ejected by the liquid ejecting head 14 is not limited to ink, but, for example, a liquid body in which particles of a functional material are dispersed or mixed or the like may be used. For example, the liquid ejecting head 14 may eject a liquid body in which a material such as an electrode material or a coloring material (pixel material) used for manufacturing a liquid crystal electroluminescence (EL) display and surface emission display is dispersed or dissolved.

Technical ideas and working effects thereof grasped from the above embodiments and modification examples will be described below.

Idea 1

A liquid ejecting apparatus including a liquid ejecting head configured to eject a liquid from an ejecting port, a liquid supply flow path of which a downstream end portion is attachably/detachably connected to the liquid ejecting head and through which the liquid is supplied from a liquid accommodating portion which accommodates the liquid to the liquid ejecting head, an opening/closing valve capable of opening and closing the liquid supply flow path, an atmosphere communication path connected to the liquid supply flow path on the downstream side of the opening/closing valve and capable of communicating with the atmosphere, an atmosphere release valve capable of opening/closing the atmosphere communication path, a suction mechanism capable of sucking the liquid in the liquid ejecting head, and a control section that controls the operations of the opening/closing valve, the atmosphere release valve, and the suction mechanism in which the control section executes a discharge operation for discharging the liquid in the liquid ejecting head by performing the suction performed by the suction mechanism for a predetermined time in a state where the opening/closing valve and the atmosphere release valve are closed prior to the removal of the liquid ejecting head from the downstream end portion of the liquid supply flow path and then opening the atmosphere release valve.

According to this, the suction by the suction mechanism is performed in a state where the opening/closing valve capable of opening and closing the liquid supply flow path and the atmosphere release valve capable of opening and closing the atmosphere communication path are closed. Therefore, the negative pressure applied to the liquid ejecting head is raised before the atmosphere release valve is opened. Also, the negative pressure applied to the liquid ejecting head is made uniform. The opening of the atmosphere release valve is performed in a state where the negative pressure applied to the liquid ejecting head is made uniform and raised. Therefore, the liquid in the liquid ejecting head is easily discharged uniformly from the liquid ejecting head. In this way, the time required for discharging the liquid in the liquid ejecting head is shortened. Therefore, it is possible to replace the liquid ejecting head easily.

Idea 2

The liquid ejecting apparatus according to Idea 1, in which the control section continues the suction by the suction mechanism even after the atmosphere release valve is opened.

According to this, the suction by the suction mechanism continues even after the atmosphere release valve is opened. Therefore, the liquid in the liquid ejecting head is discharged more reliably.

Idea 3

The liquid ejecting apparatus according to Idea 1 or 2, in which the control section closes the atmosphere release valve after the discharge operation ends.

According to this, the atmosphere release valve is closed after the discharge operation ends. Therefore, even if the liquid remains on the downstream side of the opening/closing valve in the liquid supply flow path, the leakage of the liquid from the connection portion between the liquid supply flow path and the liquid ejecting head when the liquid ejecting head is removed is suppressed.

Idea 4

The liquid ejecting apparatus according to Idea 3, in which the control section executes the resupply operation for supplying the liquid to the liquid ejecting head by performing the suction performed by the suction mechanism for a predetermined time in a state where the opening/closing valve and the atmosphere release valve are closed after the liquid ejecting head is removed and/or the same or different liquid ejecting head is connected to the downstream end portion of the liquid supply flow path and then opening the opening/closing valve.

According to this, the opening/closing valve is opened in a state where a negative pressure is applied to the liquid ejecting head after the liquid ejecting head is connected to the liquid supply flow path. Therefore, the time required for supplying the liquid into the liquid ejecting head is shortened.

Idea 5

The liquid ejecting apparatus according to Idea 4, in which the control section continues the suction by the suction mechanism even after the opening/closing valve is opened.

According to this, the suction by the suction mechanism continues even after the opening/closing valve is opened. Therefore, the supply of the liquid into the liquid ejecting head is performed more reliably.

Idea 6

The liquid ejecting apparatus according to any one of Ideas 1 to 5 in which a filter is provided between the atmosphere release valve and the liquid supply flow path in the atmosphere communication path.

According to this, a foreign matter entering from the outside when the atmosphere release valve is opened is captured by the filter before reaching the liquid ejecting head. Therefore, the occurrence of the ejection failure of the liquid caused by a foreign matter is suppressed.

Idea 7

The liquid ejecting apparatus according to any one of Ideas 1 to 6 further including a cap capable of forming a closed space in which the ejecting port is opened, in which the opening/closing valve and the atmosphere release valve are provided at positions where the volume of the portion surrounded by the ejecting port, the opening/closing valve, and the atmosphere release valve is smaller than the volume of the closed space.

According to this, it is possible to prevent the liquid from remaining in a portion surrounded by the ejecting port, the opening/closing valve, and the atmosphere release valve after the liquid removal operation.

Idea 8

The liquid ejecting apparatus according to any one of Ideas 1 to 6, when the opening/closing valve serves as the first opening/closing valve, further including a liquid collection flow path of which the upstream end portion is attachably/detachably connected to the liquid ejecting head and through which the liquid not ejected by the liquid ejecting head is collected, and a second opening/closing valve capable of opening and closing the liquid collection flow path, in which the control section executes the discharge operation for discharging the liquid in the liquid ejecting head by performing the suction performed by the suction mechanism for a predetermined time in a state where the first opening/closing valve, the second opening/closing valve, and the atmosphere release valve are closed prior to the removal of the liquid ejecting head from the downstream end portion of the liquid supply flow path and the upstream end portion of the liquid collection flow path and then opening the atmosphere release valve.

According to this, even in the liquid ejecting apparatus that includes the liquid collection flow path, the time required for discharging the liquid in the liquid ejecting head can be shortened. Therefore, it is possible to replace the liquid ejecting head easily.

Idea 9

The liquid ejecting apparatus according to any one of Ideas 1 to 6, when the opening/closing valve serves as the first opening/closing valve and the atmosphere release valve serves as the first atmosphere release valve, including a liquid collection flow path of which the upstream end portion is attachably/detachably connected to the liquid ejecting head and through which the liquid not ejected by the liquid ejecting head is collected, a second opening/closing valve for opening and closing the liquid collection flow path, and a second atmosphere communication path connected to the liquid collection flow path on the upstream side of the second opening/closing valve and capable of communicating with the atmosphere and a second atmosphere release valve capable of opening and closing the second atmosphere communication path, in which the control section executes the discharge operation for discharging the liquid in the liquid ejecting head by performing the suction performed by the suction mechanism for a predetermined time in a state where the first opening/closing valve, the second opening/closing valve, the first atmosphere release valve, and the second atmosphere release valve are closed prior to the removal of the liquid ejecting head from the downstream end portion of the liquid supply flow path and the upstream end portion of the liquid collection flow path and then opening the first atmosphere release valve and the second atmosphere release valve.

According to this, even in the liquid ejecting apparatus that includes the liquid collection flow path, the time required for discharging the liquid in the liquid ejecting head can be shortened. In particular, the liquid ejecting apparatus of Idea 9 is configured such that both the liquid supply flow path and the liquid collection flow path communicate with the atmosphere in a state where the negative pressure is applied to the liquid ejecting head. Therefore, the time required for discharging the liquid in the liquid ejecting head is further shortened.

Idea 10

A method of replacing the liquid ejecting head in the liquid ejecting apparatus, the apparatus including a liquid ejecting head that ejects the liquid, a liquid supply flow path of which the downstream end portion is attachably/detachably connected to the liquid ejecting head and through which the liquid is supplied from the liquid accommodating portion that accommodates the liquid to the liquid ejecting head, an opening/closing valve capable of opening and closing the liquid supply flow path, an atmosphere communication path connected to the liquid supply flow path on the downstream side of the opening/closing valve and capable of communicating with the atmosphere, an atmosphere release valve capable of opening and closing the atmosphere communication path, and a suction mechanism capable of sucking the ink in the liquid ejecting head, and the method including an opening/closing valve closing step of closing the opening/closing valve, an atmosphere release valve closing step of closing the atmosphere release valve, a suction step of performing the suction by the suction mechanism for a predetermined time, an atmosphere release valve opening step of opening the atmosphere release valve after the suction is performed, and a removal step of removing the liquid ejecting head from the downstream end portion of the liquid supply flow path.

According to this, the suction is performed by the suction mechanism in the suction step in a state where the opening/closing valve capable of opening and closing the liquid supply flow path and the atmosphere release valve capable of opening and closing the atmosphere communication path are closed. Therefore, the negative pressure applied to the liquid ejecting head is raised before the atmosphere release valve is opened. Also, the negative pressure applied to the liquid ejecting head is made uniform. The opening of the atmosphere release valve is performed in a state where the negative pressure applied to the liquid ejecting head is made uniform and raised in the atmosphere release valve opening step. Therefore, the liquid in the liquid ejecting head is easily discharged uniformly from the liquid ejecting head. In this way, the time required for discharging the liquid in the liquid ejecting head is shortened. Therefore, it is possible to replace the liquid ejecting head easily.

Idea 11

The method of replacing the liquid ejecting head according to Idea 10 further including the suction continuation step of continuing the suction by the suction mechanism between opening the atmosphere release valve and removing.

According to this, the suction by the suction mechanism continues even after the atmosphere release valve is opened. Therefore, the liquid in the liquid ejecting head is discharged more reliably.

The entire disclosure of Japanese Patent Application No. 2018-020075, filed Feb. 7, 2018 is expressly incorporated by reference herein.

What is claimed is:

1. A liquid ejecting apparatus comprising:

a liquid ejecting head configured to eject a liquid from an ejecting port;

a liquid supply flow path of which a downstream end portion is attachably/detachably connected to the liquid ejecting head and through which the liquid is supplied from a liquid accommodating portion that accommodates the liquid to the liquid ejecting head;

an opening/closing valve configured to open and close the liquid supply flow path;

an atmosphere communication path connected to the liquid supply flow path on a downstream side of the opening/closing valve and configured to communicate with an atmosphere;

an atmosphere release valve configured to open and close the atmosphere communication path;

a suction mechanism configured to suck the liquid in the liquid ejecting head; and a control section that controls operations of the opening/closing valve, the atmosphere release valve, and the suction mechanism, wherein the control section executes a discharge operation for discharging the liquid in the liquid ejecting head by performing a suction by the suction mechanism for a predetermined time in a state where the opening/closing valve and the atmosphere release valve are closed prior to a removal of the liquid ejecting head from the downstream end portion of the liquid supply flow path and then opening the atmosphere release valve.

2. The liquid ejecting apparatus according to claim 1, wherein the control section continues the suction by the suction mechanism even after the atmosphere release valve is opened.

3. The liquid ejecting apparatus according to claim 1, wherein the control section closes the atmosphere release valve after an end of the discharge operation.

4. The liquid ejecting apparatus according to claim 3, wherein the control section executes a resupply operation for supplying the liquid to the liquid ejecting head by performing a suction by the suction mechanism for a predetermined time in a state where the opening/closing valve and the atmosphere release valve are closed and then opening the opening/closing valve after the liquid ejecting head is removed and the same or different liquid ejecting head is connected to the downstream end portion of the liquid supply flow path.

5. The liquid ejecting apparatus according to claim 4, wherein the control section continues the suction by the suction mechanism even after the opening/closing valve is opened.

6. The liquid ejecting apparatus according to claim 1, further comprising:

a filter between the atmosphere release valve in the atmosphere communication path and the liquid supply flow path.

7. The liquid ejecting apparatus according to claim 1, further comprising:

a cap configured to form a closed space in which the ejecting port is opened, wherein the opening/closing valve and the atmosphere release valve are provided at positions where the volume of a portion surrounded by the ejecting port, the opening/closing valve, and the atmosphere release valve is smaller than the volume of the closed space.

8. The liquid ejecting apparatus according to claim 1, further comprising, when the opening/closing valve serves as a first opening/closing valve:

a liquid collection flow path of which an upstream end portion is attachably/detachably connected to the liquid ejecting head and through which the liquid not ejected by the liquid ejecting head is collected; and a second opening/closing valve configured to open and close the liquid collection flow path, wherein the control section executes the discharge operation for discharging the liquid in the liquid ejecting head by performing the suction by the suction mechanism for the predetermined time in a state where the first opening/closing valve, the second opening/closing valve, and the atmosphere release valve are closed prior to the removal of the liquid ejecting head from the downstream end portion of the liquid supply flow path and the upstream end portion of the liquid collection flow path and then opening the atmosphere release valve.

9. The liquid ejecting apparatus according to claim 1, further comprising, when the opening/closing valve serves as a first opening/closing valve and the atmosphere release valve serves as a first atmosphere release valve:

a liquid collection flow path of which an upstream end portion is attachably/detachably connected to the liquid ejecting head and through which the liquid not ejected by the liquid ejecting head is collected;

a second opening/closing valve for opening and closing the liquid collection flow path;

a second atmosphere communication path connected to the liquid collection flow path on an upstream side of the second opening/closing valve in the liquid collection flow path and configured to communicate with the atmosphere; and a second atmosphere release valve configured to open and close the second atmosphere communication path, wherein the control section executes the discharge operation for discharging the liquid in the liquid ejecting head by performing the suction by the suction mechanism for the predetermined time in a state where the first opening/closing valve, the second opening/closing valve, the first atmosphere release valve and the second atmosphere release valve are closed prior to the removal of the liquid ejecting head from the downstream end portion of the liquid supply flow path and the upstream end portion of the liquid collection flow path and then opening the first atmosphere release valve and the second atmosphere release valve.

10. A method of replacing a liquid ejecting head in a liquid ejecting apparatus, the apparatus including:

a liquid ejecting head configured to eject a liquid, a liquid supply flow path of which a downstream end portion is attachably/detachably connected to the liquid ejecting head and through which the liquid is supplied from a liquid accommodating portion that accommodates the liquid to the liquid ejecting head, an opening/closing valve configured to open and close the liquid supply flow path, an atmosphere communication path connected to the liquid supply flow path on a downstream side of the opening/closing valve and configured to communicate with an atmosphere, an atmosphere release valve configured to open and close the atmosphere communication path, and a suction mechanism configured to suck the ink in the liquid ejecting head, the method comprising:

closing the opening/closing valve;

closing the atmosphere release valve;

executing a discharge operation for discharging the liquid in the liquid ejecting head by performing a suction by the suction mechanism for a predetermined time in a state where the open/closing valve and the atmosphere release valve are closed prior to removal of the liquid ejecting head from the downstream end portion of the liquid supply flow path and then opening the atmosphere release valve.

11. The method of replacing a liquid ejecting head according to claim 10, further comprising:

continuing the suction by the suction mechanism between the opening of the atmosphere release valve and the removing of the liquid ejecting head.

* * * * *